US008353784B2

(12) United States Patent
Boyd et al.

(10) Patent No.: US 8,353,784 B2
(45) Date of Patent: Jan. 15, 2013

(54) GOLF CLUB WITH A SUPPORT BRACKET

(75) Inventors: Robert Boyd, Euless, TX (US); Andrew G. V. Oldknow, Beaverton, OR (US); Adam D. Liber, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 485 days.

(21) Appl. No.: 12/624,168

(22) Filed: Nov. 23, 2009

(65) Prior Publication Data

US 2011/0124433 A1 May 26, 2011

(51) Int. Cl.
*A63B 53/04* (2006.01)
*A63B 53/06* (2006.01)

(52) U.S. Cl. ..... 473/334; 473/346; 473/350

(58) Field of Classification Search ..... 473/324–350
See application file for complete search history.

(56) References Cited

U.S. PATENT DOCUMENTS

| | | | | | |
|---|---|---|---|---|---|
| 1,582,836 | A | * | 4/1926 | Link | 473/346 |
| 4,147,349 | A | * | 4/1979 | Jeghers | 473/291 |
| 4,247,105 | A | * | 1/1981 | Jeghers | 473/291 |
| 4,322,083 | A | * | 3/1982 | Imai | 473/344 |
| 4,602,787 | A | * | 7/1986 | Sugioka et al. | 473/338 |
| 4,836,550 | A | * | 6/1989 | Kobayashi | 473/350 |
| 5,183,255 | A | * | 2/1993 | Antonious | 473/314 |
| 5,209,473 | A | * | 5/1993 | Fisher | 473/291 |
| 5,295,689 | A | * | 3/1994 | Lundberg | 473/346 |
| 5,401,021 | A | | 3/1995 | Allen | |
| 5,419,559 | A | * | 5/1995 | Melanson et al. | 473/346 |
| 5,547,194 | A | | 8/1996 | Aizawa et al. | |
| 5,584,770 | A | * | 12/1996 | Jensen | 473/350 |
| 5,839,975 | A | | 11/1998 | Lundberg | |
| 5,938,540 | A | * | 8/1999 | Lu | 473/288 |
| 5,941,782 | A | | 8/1999 | Cook | |
| 6,027,415 | A | | 2/2000 | Takeda | |
| 6,059,669 | A | | 5/2000 | Pearce | |
| 6,077,171 | A | * | 6/2000 | Yoneyama | 473/291 |
| 6,086,485 | A | * | 7/2000 | Hamada et al. | 473/329 |

(Continued)

FOREIGN PATENT DOCUMENTS

| | | |
|---|---|---|
| GB | 2310379 | 8/1997 |

(Continued)

OTHER PUBLICATIONS

International Search Report corresponding to International PCT Application No. PCT/US2010/054063, mailed Feb. 28, 2011.

*Primary Examiner* — Alvin Hunter
(74) *Attorney, Agent, or Firm* — Banner & Witcoff, Ltd.

(57) ABSTRACT

A cavity back golf club and golf club head having one or more support brackets is disclosed. Each support bracket includes a first portion engaged with the rear surface of the striking face, a second portion engaged with the perimeter weighting member, and a third portion that is curved. The one or more of the support brackets are engaged with a rear surface of a striking face and a perimeter weight member of the golf club head. The one or more support brackets are at least partially located in a rear cavity of the golf club head. The support brackets provide structural integrity to a thin striking face on the golf club head. Additionally, a discretionary weight is engaged with the at least one of the support brackets at the toe portion of the golf club head.

30 Claims, 9 Drawing Sheets

U.S. PATENT DOCUMENTS

| | | | | |
|---|---|---|---|---|
| 6,162,133 | A * | 12/2000 | Peterson | 473/345 |
| 6,379,262 | B1 | 4/2002 | Boone | |
| 6,422,951 | B1 | 7/2002 | Burrows | |
| 6,454,665 | B2 * | 9/2002 | Antonious | 473/346 |
| 6,558,271 | B1 | 5/2003 | Beach et al. | |
| 6,685,577 | B1 * | 2/2004 | Scruggs et al. | 473/349 |
| 6,743,117 | B2 * | 6/2004 | Gilbert | 473/332 |
| 6,780,123 | B2 * | 8/2004 | Hasebe | 473/291 |
| 6,811,496 | B2 * | 11/2004 | Wahl et al. | 473/334 |
| 6,872,153 | B2 * | 3/2005 | Gilbert et al. | 473/332 |
| 6,875,124 | B2 * | 4/2005 | Gilbert et al. | 473/290 |
| 7,121,956 | B2 * | 10/2006 | Lo | 473/335 |
| 7,169,062 | B2 * | 1/2007 | Chen | 473/342 |
| 7,207,900 | B2 * | 4/2007 | Nicolette et al. | 473/334 |
| 7,247,103 | B2 * | 7/2007 | Beach et al. | 473/324 |
| 7,357,731 | B2 * | 4/2008 | Johnson et al. | 473/349 |
| 7,390,271 | B2 | 6/2008 | Yamamoto | |
| 7,530,902 | B2 * | 5/2009 | Nakamura | 473/334 |
| 7,575,524 | B2 * | 8/2009 | Willett et al. | 473/342 |
| 7,585,233 | B2 * | 9/2009 | Horacek et al. | 473/345 |
| 7,614,962 | B1 * | 11/2009 | Clausen | 473/291 |
| 7,713,141 | B2 * | 5/2010 | Yamamoto | 473/332 |
| 7,789,771 | B2 * | 9/2010 | Park et al. | 473/332 |
| 7,815,522 | B2 * | 10/2010 | Horacek et al. | 473/345 |
| 7,828,674 | B2 * | 11/2010 | Kubota | 473/335 |
| 7,828,676 | B2 * | 11/2010 | Wada et al. | 473/346 |
| 7,892,106 | B2 * | 2/2011 | Matsunaga | 473/290 |
| 7,927,232 | B2 * | 4/2011 | Horacek et al. | 473/345 |
| 8,033,932 | B2 * | 10/2011 | Wada et al. | 473/346 |
| 8,070,623 | B2 * | 12/2011 | Stites et al. | 473/329 |
| 8,088,024 | B2 * | 1/2012 | Horacek et al. | 473/345 |
| 2001/0001774 | A1 | 5/2001 | Antonious | |
| 2008/0146374 | A1 | 6/2008 | Beach et al. | |
| 2008/0242444 | A1 | 10/2008 | Park et al. | |

FOREIGN PATENT DOCUMENTS

| | | | |
|---|---|---|---|
| JP | 06182005 | A * | 7/1994 |
| JP | 09239074 | A * | 9/1997 |
| JP | 09239075 | A * | 9/1997 |
| JP | 11042300 | A * | 2/1999 |
| JP | 11137733 | A * | 5/1999 |
| JP | 11235406 | A * | 8/1999 |
| JP | 2000317018 | A * | 11/2000 |
| JP | 2002320692 | A * | 11/2002 |
| JP | 2007044148 | | 2/2007 |
| WO | 9922824 | | 5/1999 |

* cited by examiner

GOLF CLUB WITH A SUPPORT BRACKET

FIELD OF THE INVENTION

The invention relates generally to golf clubs, and specifically iron-type golf clubs. More particularly, the invention concerns cavity back golf clubs and golf club heads.

BACKGROUND

Various golf club heads have been designed to improve a golfer's accuracy by assisting a golfer to square the club head face at impact with a golf ball. A number of these golf club heads reposition the weight of the golf club head in order to alter the location of the center of gravity. The location of the center of gravity of the golf club head is one factor that determines whether a golf ball is propelled in the intended direction and/or with the intended trajectory. When the center of gravity is positioned behind the point of engagement on the contact surface, the golf ball follows a generally straight route. When the center of gravity is spaced to a side of the point of engagement, however, the golf ball may follow a route that curves left or right, which is often referred to as a hook or a slice. Similarly, when the center of gravity is spaced above or below the point of engagement, the route of the golf ball may exhibit a boring or climbing trajectory.

Golf club heads, such as cavity back iron club heads, assist the golfer by locating the weight of the golf club head around the golf club head perimeter. Generally, the perimeter weighting increases the club head's moment of inertia about a vertical axis (Izz), which increases the club head's resistance to twisting about the vertical axis. Therefore, these perimeter weighted golf club heads are more forgiving than non-cavity back golf club heads thereby allowing a golf ball to be struck somewhat off center or miss-hit, while still providing relatively good distance and accuracy. Perimeter weighting, however, tends to provide a relatively high center of gravity of the club head, which can provide somewhat limited control of the trajectory of a ball hit by this golf club head. Therefore, there is a need in the art for a golf club head that repositions additional weight away from the golf club head face and/or lower in the golf club head structure to allow further options in positioning the center of gravity of a golf club head and/or to provide additional options in ball flight trajectory when using such club heads.

SUMMARY

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to golf club heads for iron-type golf clubs (including 1 through 9 irons, iron-type hybrid clubs, driving irons, and wedges (e.g., pitching wedges, lob wedges, gap wedges, sand wedges, etc.)) that include: a striking face that provides a front surface for engaging a golf ball and a rear surface opposite the front surface, a perimeter weighting member that extends rearward from the striking face and around at least a majority of a circumference of the striking face, and a plurality of support brackets at least partially located in the rear cavity. Each support bracket has a first portion engaged with the rear surface of the striking face, a second portion engaged with the perimeter weighting member, and a third portion connecting the first and second portions. The plurality of support brackets may include at least one upper support bracket engaged with the perimeter weighting member at a top portion of the club head and/or at least one lower support bracket engaged with the perimeter weighting member at a sole portion of the club head.

Additionally, the golf club head may include a plurality of support brackets with at least one pair of support brackets. The pair of support brackets may include an upper support bracket and a lower support bracket, wherein the upper support bracket is engaged with the perimeter weighting member at a top portion of the club head and the lower support bracket is engaged with the perimeter weighting member at a sole portion of the club head. In an additional aspect of this invention, the plurality of support brackets includes two pairs of support brackets, wherein each pair of support brackets includes an upper support bracket and a lower support bracket. The upper support brackets are engaged with the perimeter weighting member at a top portion of the club head and the lower support brackets are engaged with the perimeter weighting member at a sole portion of the club head. The support brackets may be made of a material selected from the group consisting of: aluminum, magnesium, beryllium, titanium aluminum alloys, magnesium alloys, beryllium alloys, titanium alloys, thermoplastic polymers, thermosetting polymers, carbon-fiber reinforced composite materials, and glass-fiber reinforced materials.

Additional aspects of the present invention may include providing a discretionary weight engaged with at least one or more of the support brackets. The discretionary weight may be at least 4 grams or within a range of 5 grams to 30 grams. The discretionary weight member may be made of a material selected from the group consisting of lead, tungsten, lead alloys, tungsten alloys, other metal materials that include lead, other metal materials that include tungsten, polymeric materials that include lead, and polymeric materials that include tungsten. Additionally, at least 50% of an overall surface of the striking face may have a thickness from the front surface to the rear surface of no greater than 0.1 inches.

Additional aspects relate to golf club structures that include golf club heads, e.g., of the types described above. Such golf club structures further may include one or more of: a shaft attached to the club head (via a hosel), and a grip attached to the shaft.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientation at the address position. Nothing in this specification should be construed as requiring a specific three dimensional orientation of structures in order to fall within the scope of this invention.

Figure 1:
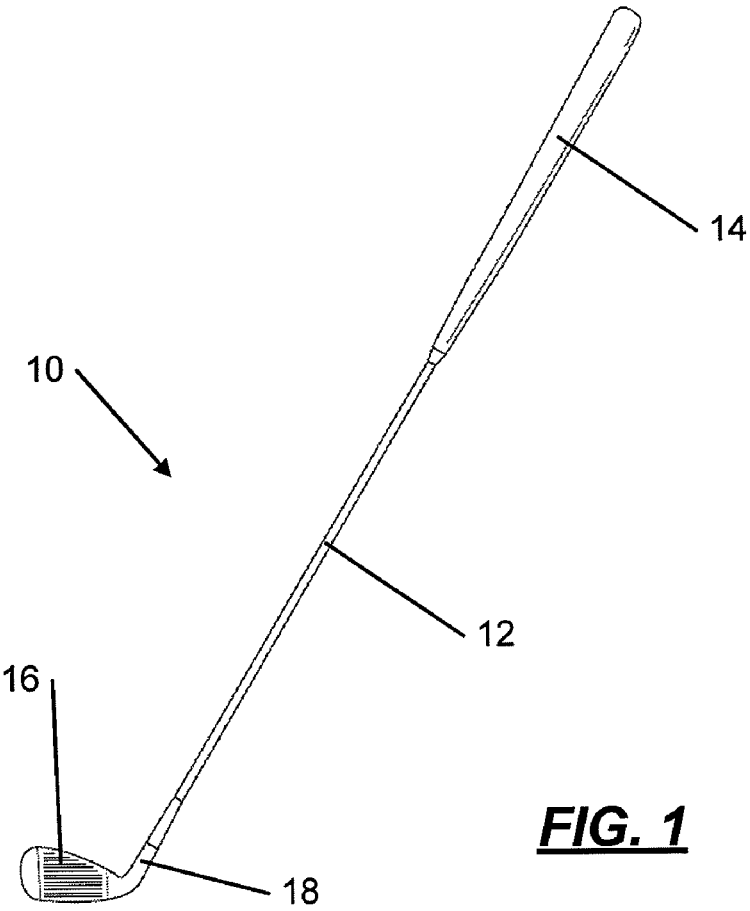
FIG. 1 illustrates an elevation view of a golf club having a golf club head in accordance with the present invention.

A. General Description of Basic Features of Iron-Type Golf Clubs According to Examples of this Invention FIG. 1 illustrates an example of an iron-type golf club 10 in accordance with the present disclosure. The golf club 10 includes a shaft 12, a grip 14, and a golf club head 16. The club head 16 of FIG. 1 may be representative of a five iron golf club head of the present invention. The shaft 12 of the golf club 10 may be made of various materials such as steel, titanium, graphite, polymers, or composite materials, including conventional materials as are known and used in the art. The grip 14 is positioned on the shaft 12 to provide a golfer with a slip resistant surface in which to grasp the golf club 10. The grip 14 may be attached to, engaged with, and/or extend from the shaft 12 in any suitable or desired manner, including conventional manners known and used in the art, e.g., using adhesives or cements; via welding soldering, brazing, or the like; via mechanical connectors (such as threads, retaining elements, etc., including through releasable connection structure. A hosel 18 may be connected or part of the golf club head 16 for connecting the shaft 12 of FIG. 1 to the golf club head 16.

The shaft 12 may be received in, engaged with, and/or attached to the club head body 16 in any suitable or desired manner, including conventional manners known and used in the art, without departing from this disclosure. As more specific examples, the shaft 12 may be engaged with the club head 16 via adhesives, cements, welding, soldering, mechanical connectors (such as threads, retaining elements, or the like), etc. If desired, the shaft 12 may be connected to the club head 16 in a releasable manner using mechanical connectors to allow easy interchange of one shaft 12 for another on the club head 16.

B. Detailed Description of Aspects of this Invention

The various figures in this application illustrate examples of golf clubs and golf club heads according to this invention. When the same reference number appears in more than one drawing, that reference number is used consistently in this specification and the drawings to refer to the same or similar parts throughout.

1. Iron-Type Golf Club Heads According to Examples of this Invention

Figure 2:
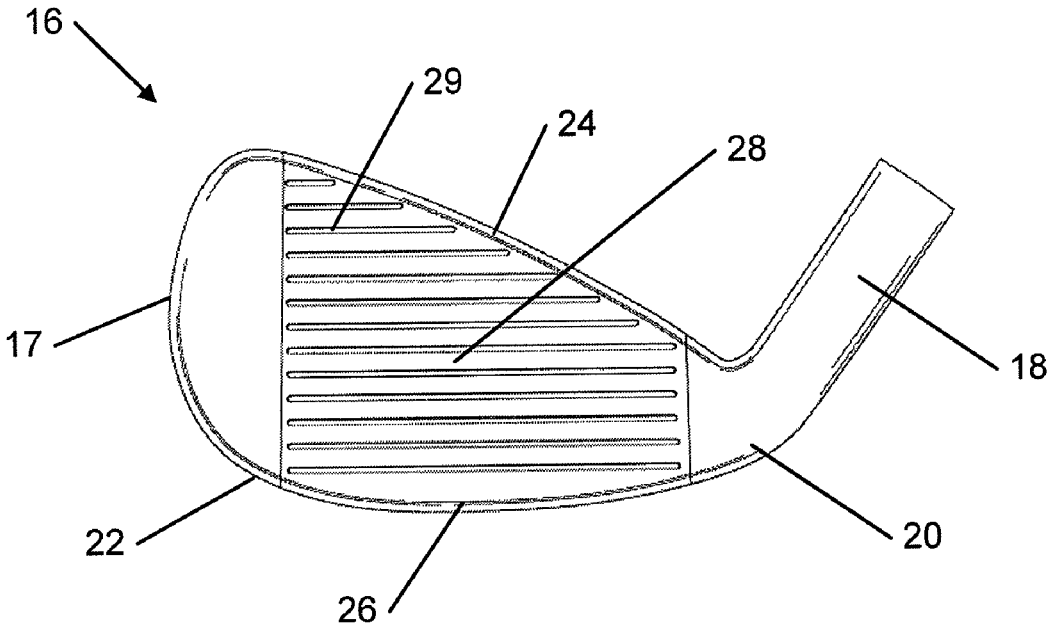
FIG. 2 illustrates a front view of a golf club head in accordance with the present invention.
Figure 3:
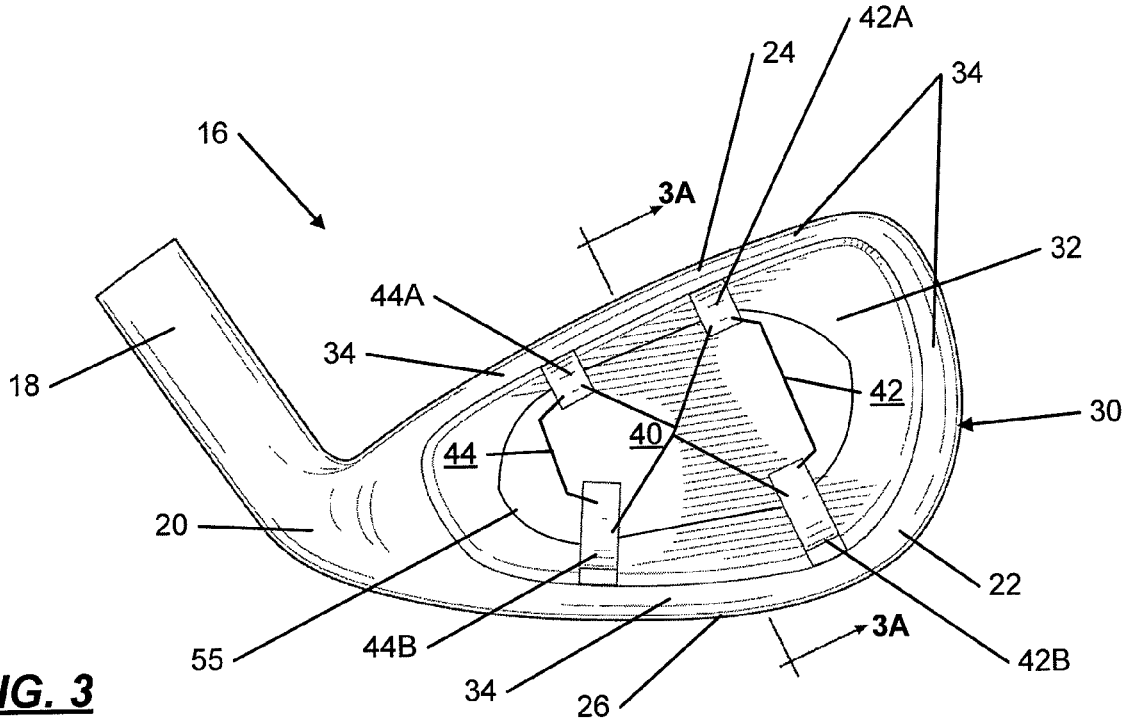
FIG. 3 illustrates a rear view of an example golf club head in accordance with the present invention.
Figure 3A:
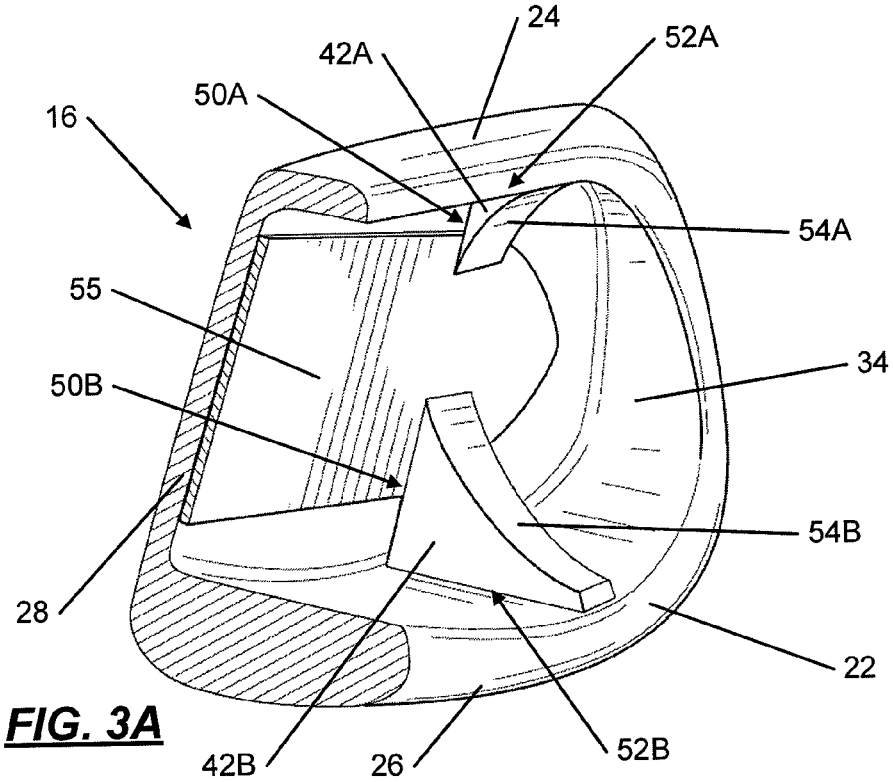
FIG. 3A illustrates a perspective cross-sectional view along line 3A-3A from the golf club head as illustrated in FIG. 3 in accordance with the present invention.

As shown in FIGS. 2 and 3, the golf club head 16 comprises a body 17, the body including a heel 20, a toe 22, a top portion 24, and a sole portion 26; a striking face 28; a rear portion 30; a plurality of support brackets 40; and a perimeter weighting member 34. The term "heel" of the club head body 17, as used herein, means the side of the club head body 17 at which the shaft 12 is mounted. The term "toe" of the club head body 17, as used herein, means the side of the club head body 17 opposite the side that the shaft 12 is mounted. FIG. 3A shows a cross-section of the example club head in FIGS. 2 and 3.

A wide variety of club head constructions are possible without departing from this disclosure. For example, if desired, some or all of the various individual parts of the club head body 17 described above may be made from multiple pieces that are connected together (e.g., by adhesives or cements; by welding, soldering, brazing, or other fusing techniques; by mechanical connectors; etc.). The various parts (e.g., top portion 24, sole portion 26, etc.) may be made from any desired materials and combinations of different materials, including materials that are conventionally known and used in the art, such as metal materials, including lightweight metal materials, composite materials, polymer materials, steel, titanium, aluminum, tungsten, magnesium, beryllium, alloys including one or more of these metals, carbon-fiber reinforced materials, glass-fiber reinforced materials, graphite, etc.

Additionally, the club head 16 may be constructed in any suitable or desired manner and/or from any suitable or desired materials without departing from this disclosure, including from conventional materials and/or in conventional manners known and used in the art. The club head 16 and its various parts may be made by forging, casting, molding, and/or using other techniques and processes, including techniques and processes that are conventional and known in the art.

The dimensions and/or other characteristics of a golf club head 16 according to examples of this disclosure may vary significantly without departing from the disclosure. For example, any iron-type club head may be provided including for example, iron-type hybrid clubs, driving irons, 1 through 9 irons, wedges (e.g., pitching wedges, lob wedges, gap wedges, sand wedges, etc.), and chipping clubs.

During the game of golf, the golfer holds the grip 14 and swings the golf club 10 such that the golf club head 16 traverses a generally arcuate path and impacts a golf ball. A portion of the momentum of the golf club 10, and particularly the momentum of the golf club head 16, is then transferred to the golf ball and propels the golf ball toward an intended target. More specifically, the golf ball follows a generally straight route when the center of gravity is positioned behind the point of engagement on striking face 28. When the center of gravity is spaced to one side of the point of engagement, however, the golf ball may follow a route that curves left or right. The position of the center of gravity of golf club head 16 also has an influence upon whether the golf ball exhibits a boring or climbing trajectory, depending upon whether the center of gravity is spaced above or below the point of engagement on striking face 28.

Although the concepts behind utilizing a golf club to propel a golf ball toward an intended target appear simplistic, the actual practice of propelling the golf ball in an intended manner is exceedingly complex. The golf ball may, for example, consistently curve right when, in fact, the individual intends to propel the golf ball along a straight route. Many conventional golf club heads 16 have a center of gravity located at or near the striking face 28. However, changing the position of the center of gravity of the golf club head 16 for different golf clubs may assist many golfers in squaring the club head face upon impact with a golf ball and/or getting the ball airborne. The positioning of the center of gravity off of the striking face 28 and toward the rear of the golf club head 16 may help many golfers who struggle to square the club face at impact (e.g., may help propel the ball straighter, in the intended direction, and may help get the ball airborne). Accordingly, golfers may be able to correct or modify the route of the golf ball by using the golf club head 16 of the present invention as the center of gravity of golf club head 16 is repositioned with respect to striking face 28 as compared to other golf club heads.

The center of gravity of golf club head 16, otherwise referred to as the center of mass, is defined as an equilibrium point. More specifically, the center of gravity of golf club head 16 is a point at which the entire weight of golf club head 16 may be considered as concentrated so that, if supported at that point, head 16 would remain in static equilibrium in any position. The location of the center of gravity of golf club head 16 may be changed by altering the weight distribution of the golf club head 16, e.g., by adding weight low and in the rear portion of the club head. Altering the weight distribution of the golf club head 16 may be accomplished, in accordance with at least some examples of this invention, with the use of a thin striking face 28 and a support bracket 40 as described below. The weight savings generated from using both the thin striking face 28 (as compared to a striking face of conventional thickness) and the support brackets 40 can then be placed in a location to alter the weight distribution to improve the playing characteristics of the golf club 10. The weight distribution may be altered to allow some of the weight of the club head 16 (which would have previously been part of the striking face 28) to be selectively located at other desired locations in the club head 16.

As is shown in FIG. 2, the striking face 28 is located between the top portion 24 and the sole portion 26, and between the heel 20 and the toe 22. The striking face 28 of the present invention is generally a thin face to help reduce the overall weight of the golf club 10. Generally, a conventional striking face is normally at least 0.125 inches thick, while weighing at least about 80 grams. The striking face 28 of the present invention may be as thin as 0.06 inches and may weigh 45 grams or less. In some example club heads in accordance with this invention, the striking face 28 will include at least some portions with thicknesses in the range of 0.05 to 0.1 inches, and in some more specific examples, within the range of 0.06 to 0.08 inches.

Additionally, the striking face 28 of the present invention may have a variable thickness such that some area is thin while other areas are thicker. For example, in one aspect of the invention, the top of the striking face may be thin, such as 0.06 inches, and the bottom of the striking face may remain as thick as conventional striking faces. Another aspect of the invention may have the inner area of the striking face thin, such as 0.08 inches, and the outer area of the striking face thicker. A variety of combinations of thin and thick areas may be provided for the striking face without departing from this invention.

The striking face 28 provides a contact area for engaging and propelling a golf ball in an intended direction. The striking face 28 comprises horizontal grooves 29 for the removal of water and grass from the striking face during impact with a golf ball. The horizontal grooves 29 also help to impart spin to the golf ball so that the golfer may control the flight and/or landing characteristics of the golf ball.

FIG. 3 illustrates a rear view of an example golf club head 16 according to this invention. The golf club head 16 of this example structure includes a rear portion 30 positioned opposite the striking face 28 (which may simply constitute the rear surface of the striking face 28).

As seen in FIG. 3, the golf club head 16 may include the perimeter weighting member 34. The perimeter weighting member 34 may extend rearward from the striking face 28 and along at least a portion of the circumferential area of the rear portion 30. If desired, the perimeter weighting member 34 may extend around the entire circumferential area of the rear portion 30. The perimeter weighting member 34 defines a rear cavity 32 having a large opening extending toward the rear portion 30 and away from a rear surface of the ball striking face 28. In order to provide sufficient durability for the thin striking face 28 as described above, one or more support brackets 40 may be utilized.

2. Support Brackets According to Examples of this Invention

As is illustrated in FIG. 3, the plurality of support brackets 40 fit within the rear cavity 32. The support brackets 40 of the present invention may provide many advantages over previous structures in cavity back irons. The support brackets 40 provide the benefit of providing adequate support to the ball striking face 28 during impact by increasing the face stiffness and the strength of the ball striking face 28. Additionally, the support brackets 40 provide this support while saving weight, so that the center of gravity of the overall club head may be moved to alter the weight distribution and to improve the playing characteristics of the golf club 10.

The plurality of support brackets 40 may consist of a varied number of support brackets. Generally, the plurality of support brackets 40 includes at least one pair of support brackets 42, wherein the pair of support brackets 42 includes an upper support bracket 42A and a lower support bracket 42B. As illustrated in the example club head 16 structure of FIG. 3, there are two pairs of support brackets 42, 44 wherein there is a first upper support bracket 42A and a second upper support bracket 44A along with a first lower support bracket 42B and a second lower support bracket 44B. Each of the support brackets 42, 44 may be engaged with the rear surface of the striking face 28 and the perimeter weighting member 34. Additionally, the support brackets 40 may be completely bonded to the rear portion 30 of the striking face 28 and the perimeter weighting member 34 where the various parts contact one another. The support brackets 40 may be bonded to one or more other portions of the club head using adhesives or cements; via welding soldering, brazing, or the like. Alternatively, if desired, the support brackets 40 may be connected to one or more other portions of the club head 16 via one or more mechanical connectors (such as threads, retaining elements, etc.).

Also, in some example club head structures according to this invention, the support brackets 40 may be wedged between the inner walls of the rear portion 30 of the face and the perimeter weighting member 34. This wedging may provide additional support to the bonding or connecting as described above. The support brackets 40 may be wedged between any of the structures on the rear portion 30 of the face without departing from this invention.

The support brackets 40 can be made of any light-weight material, such as aluminum, magnesium, beryllium, titanium, aluminum alloys, magnesium alloys, beryllium alloys, titanium alloys, polymers (e.g., PEBAX® (a polyether-block co-polyamide polymer available from Atofina Corporation of Puteaux, France), thermoplastic polymers, thermosetting polymers, etc.), carbon fiber reinforced polymers, glass reinforced polymers, etc. The support brackets 40 may be made from a variety of techniques, such as forging, casting, molding (including blow molding and injection molding, etc.) and/or using other techniques or processes, including techniques and processes that are conventional and known in the art. Additionally, the support brackets 40 may be attached to the club head 16 by a variety of techniques, such as by adhesives or cements; by welding, soldering, brazing, or other fusing techniques; by mechanical connectors (e.g., threads, retaining elements, etc., including through releasable connection structures).

As shown in FIGS. 3 and 3A, in one example structure according to this invention, the plurality of support brackets 40 includes two pairs of support brackets 42, 44. Each pair of support brackets 42, 44 includes an upper support bracket 42A, 44A and a lower support bracket 42B, 42B. The upper support bracket 42A, 44A may engage the striking face 28 and the perimeter weighting member 34 at the top portion 24 of the club head 16. The lower support bracket 42B, 44B may engage the striking face 28 and the perimeter weighting member 34 at the sole portion 26 of the club head 16.

As shown in FIG. 3A, each support bracket 42, 44 may be generally in the shape of a triangle, e.g., a right triangle. Each support bracket 42, 44 may include a first side 50A, 50B and a second side 52A, 52B. The first side 50A, 50B and the second side 52A, 52B may be at an approximate right angle. The first side 50A, 50B may be engaged with the striking face 28. The second side 52A, 52B may be engaged with the perimeter weighting member 34. For the upper support brackets 42A, 44A, the second side 52A may be engaged with the upper perimeter weighting member 34 at the top portion 24 of the club head 16. For the lower support brackets 42B, 44B, the second side 52B may be engaged with the lower perimeter weighting member 34 at the sole portion 26 of the club head 16.

In another aspect of this invention, an intervening member, such as a dampening member 55, may be located between the support brackets 40 and the rear surface of the striking face 28 being supported. If the dampening portion 55 is attached to the striking face 28, the first side 50A, 50B may be engaged with the dampening portion 55.

The first side 50A, 50B and the second side 52A, 52B may be connected by a third side 54A, 54B. The third side 54A, 54B may have a variety of different shapes without departing from this invention. For example, the third side 54A, 54B may be a straight surface connecting the first side 50A, 50B and the second side 52A, 52B. Additionally, the third side 54A, 54B may be a curved surface connecting the first side 50A, 50B and the second side 52A, 52B, wherein the curved surface may be a portion of a circle or oval. Additionally, the third side 54A, 54B may be a curved surface connecting the first side 50A, 50B and the second side 52A, 52B, wherein the curved surface may be other shapes such as elliptical shapes, parabolic shapes, or hyperbolic shapes, etc.

Figure 11A:
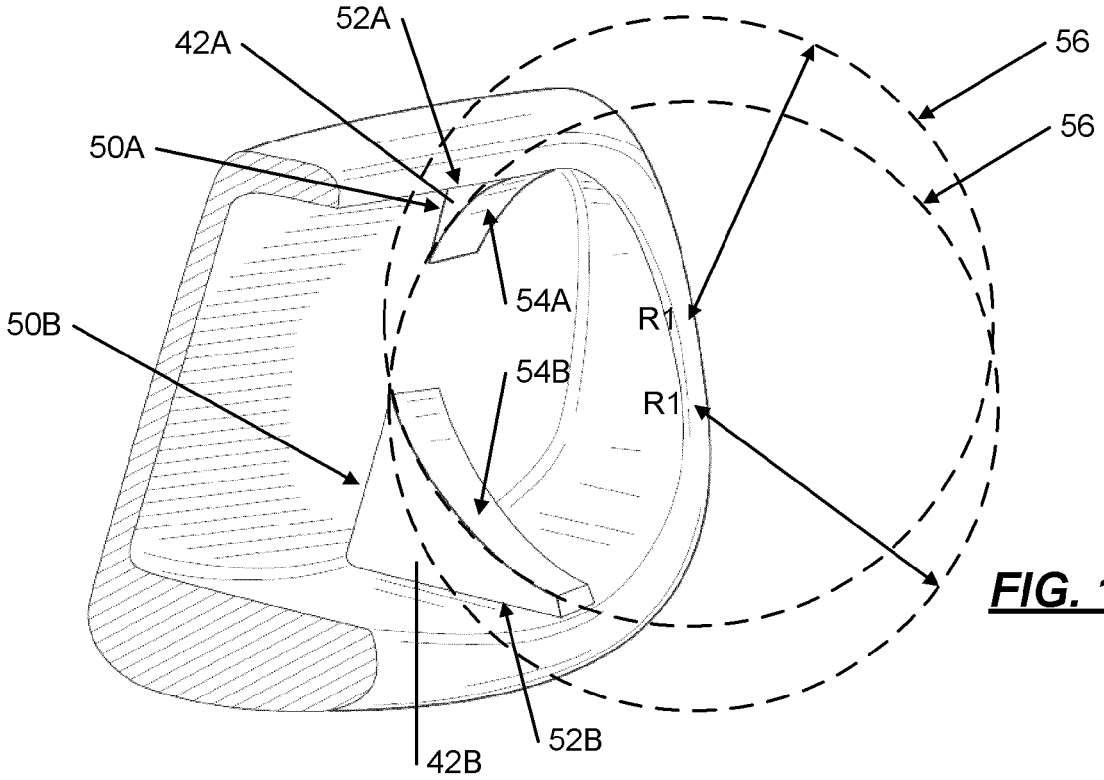
FIGS. 11A through 11C illustrate a representation of exemplary support brackets with a circle and a radius in accordance with the present invention.
Figure 11B:
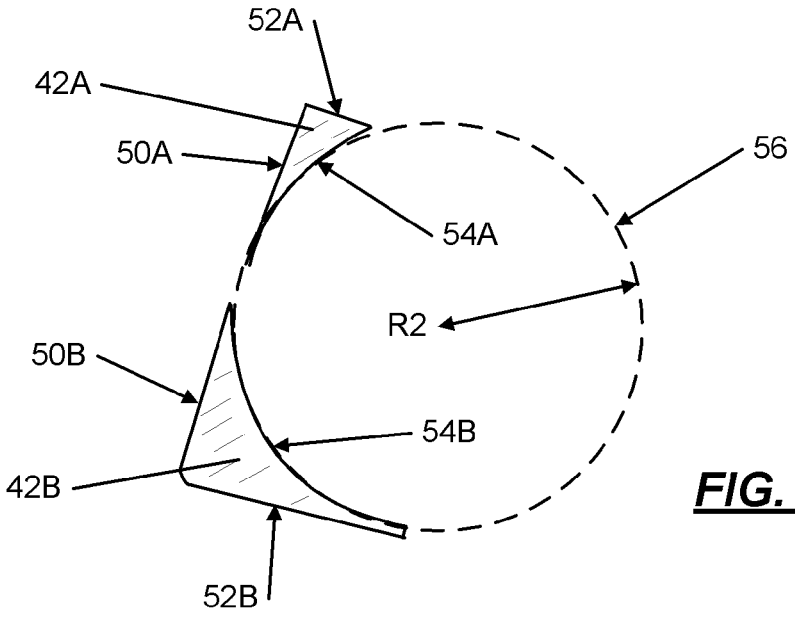
Figure 11C:
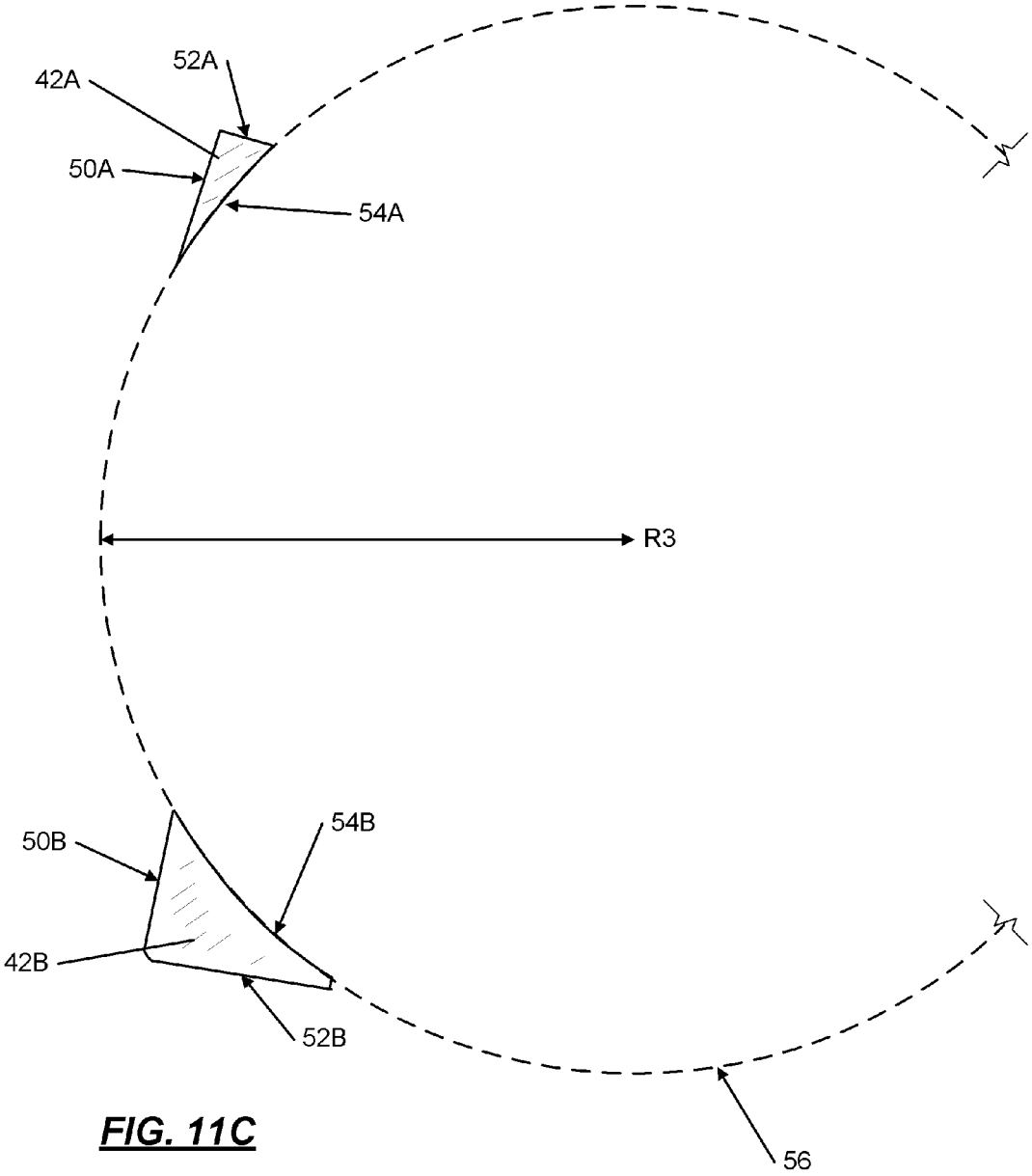
Figure 12:
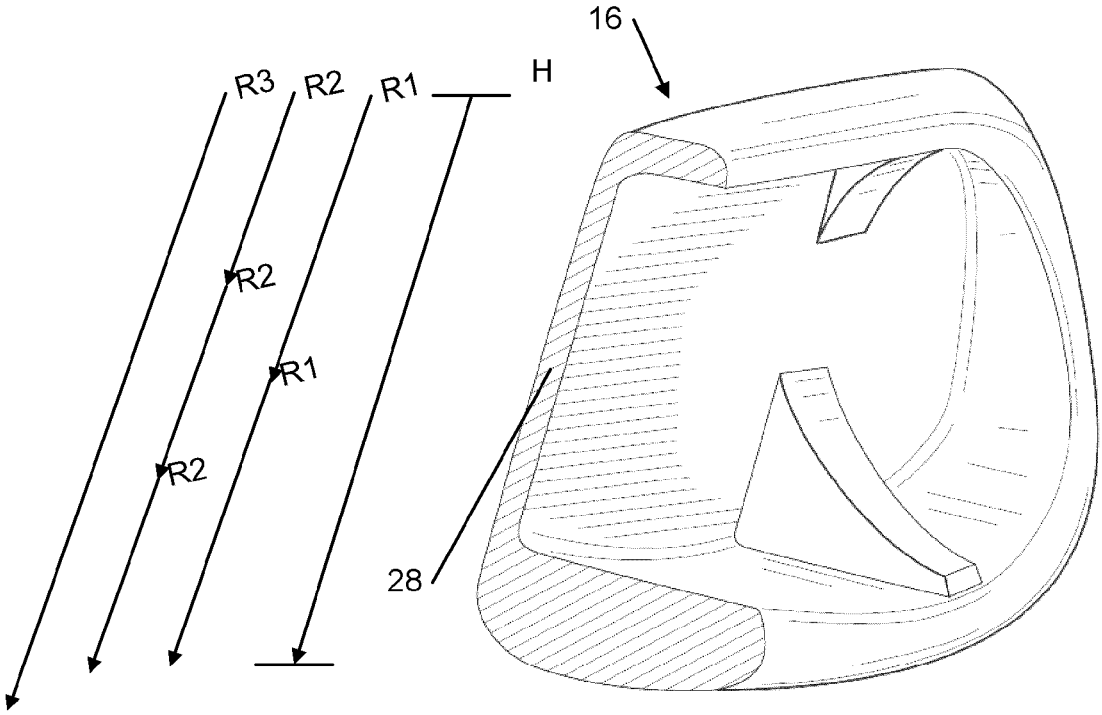
FIG. 12 illustrates a comparative view of the radius of the support brackets from FIGS. 11A through 11C with the height of the striking face in accordance with the present invention.

In another example club head 16 in accordance with the invention, the third side 54A, 54B connecting the first side 50A, 50B and the second side 52A, 52B may be a concavely curved surface, such that the curved surface curves inward toward the striking face 28 and the perimeter weighting member 34. Additionally, the curved surface of the third side 54A, 54B may be equivalent to an arc of a circle 56 with a radius R1, R2, R3 as illustrated in FIGS. 11A through 11C. Additionally, the third side 54A, 54B may correspond to a ratio defined as the height H of the striking face 28 to the radius R1, R2, R3. As illustrated in FIG. 11A, in one example club head 16 according to the present invention, the ratio may be approximately 2, which corresponds to the radius R1 being approximately 2 times the height H of the striking face 28. As illustrated in FIG. 11B, in another example club head 16 according to the present invention, the ratio may be approximately 3, which corresponds to the radius R2 being approximately 3 times the height H of the striking face 28. As illustrated in FIG. 11C, in another example club head 16 according to the present invention, the ratio may be approximately 1, which corresponds to the radius R1 being approximately equal to the height H of the striking face 28. The height H of the striking face 28 and the equivalent radius R1, R2, R3 measurements are illustrated in FIG. 12. In general, the height H to radius R may be within a range of 0.75 to 5.

When there are multiple support brackets 40 attached to the club head 16, the third side 54A, 54B of each support bracket 40 may be in the shape of an arc from a circle with the same radius. Conversely, the third side 54A, 54B of each support bracket 40 may be in the shape of an arc from a circle with different radii. Additionally, when there are multiple support brackets 40 attached to the club head 16, the third side 54A, 54B of the upper support bracket and the lower support bracket may be formed from an arc from one single continuous circle between the upper support bracket and the lower support bracket. Conversely, the third side 54A, 54B of the upper support bracket may be formed from an arc from a first circle and the lower support bracket may be formed from an arc from a second circle. The first circle and second circle may have the same or different radii.

While the support brackets 40 in FIG. 3 are in a specific position, it is possible that the positions of the support brackets 40 may be selectively controlled such that the area between the first pair of support brackets 42 and the second pair of support brackets 44 is located so as to provide an area that improves corresponding ball speed at impact. For example, to take better advantage of the coefficient of restitution (COR), the ball should hit on the most flexible area of the striking face 28. If a user tends to hit the ball predominantly at a relatively small area of the striking face 28 (e.g., as determined from repeated ball hits using impact tape or other impact location determining technology), providing the pair of support brackets 42, 44 away from this area may improve the COR response of the striking face 28 for the user while still providing adequate face strength during ball impact with the ball face.

Figure 6:
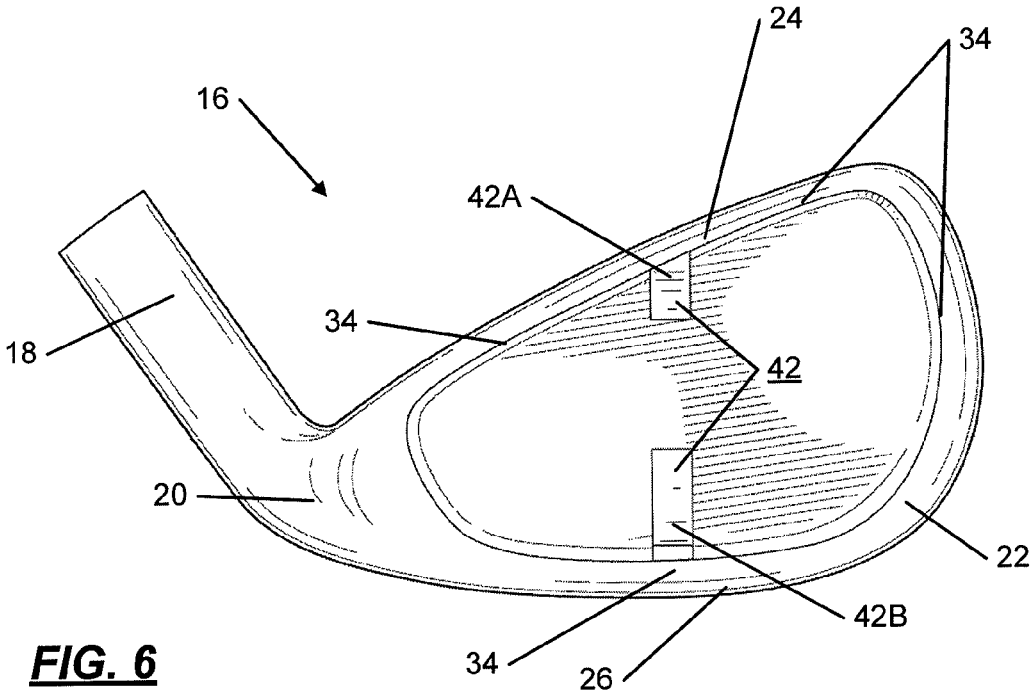
FIG. 6 illustrates a rear view of an example golf club head in accordance with the present invention.

As shown in FIG. 6, in another example club head structure 16 according to this invention, the plurality of support brackets includes only one pair of support brackets 42. There may be one upper support bracket 42A and one lower support bracket 42B in accordance with examples of this invention.

Figure 7:
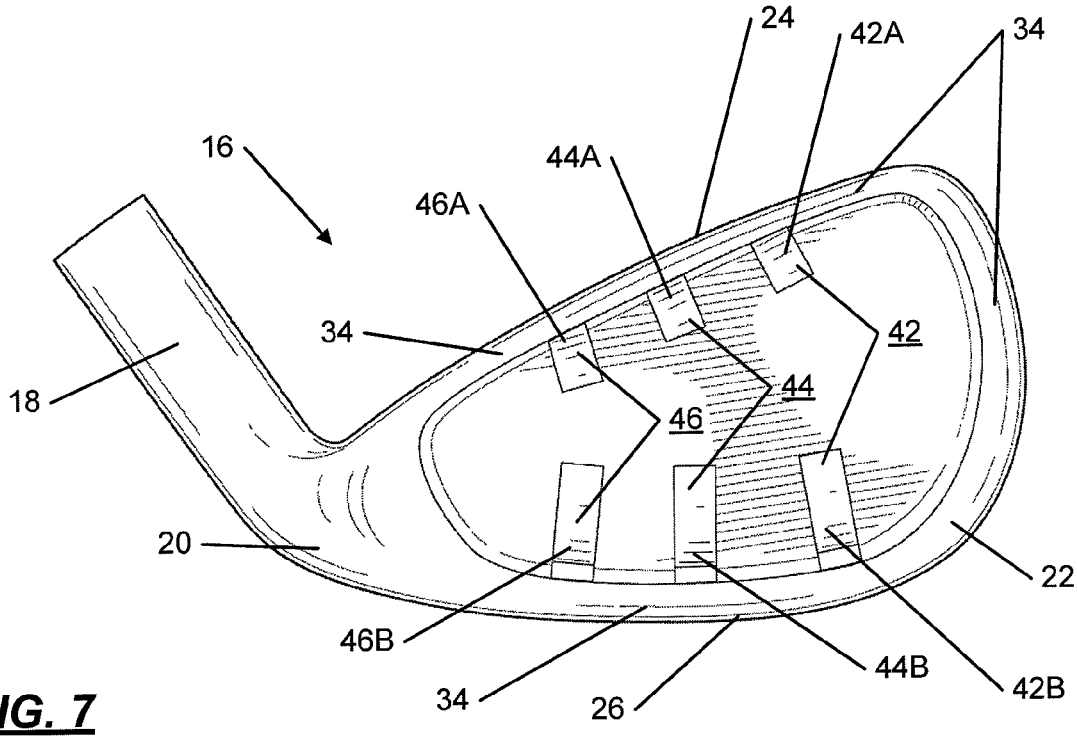
FIG. 7 illustrates a rear view of an example golf club head in accordance with the present invention.

As shown in FIG. 7, in another example club head 16 structure according to this invention, the plurality of support brackets includes three pairs of support brackets 42, 44, 46. There may be three upper support brackets 42A, 44A, 46A and three lower support brackets 42B, 44B, 46B in accordance with examples of this invention.

In another example club head structure according to this invention, the upper and lower support brackets may be connected as a unit, e.g. by a thin piece of material extending between the bottom of the upper and top of the lower support brackets.

Additionally, a variety of combinations of support brackets 40 may be provided without departing from this invention. For example, the golf club head 16 may include one upper support bracket and two lower support brackets. In another example, the golf club head 16 may include two upper support brackets and three lower support brackets. In another example, the golf club head 16 may include two upper support brackets and one lower support bracket.

Figure 8:
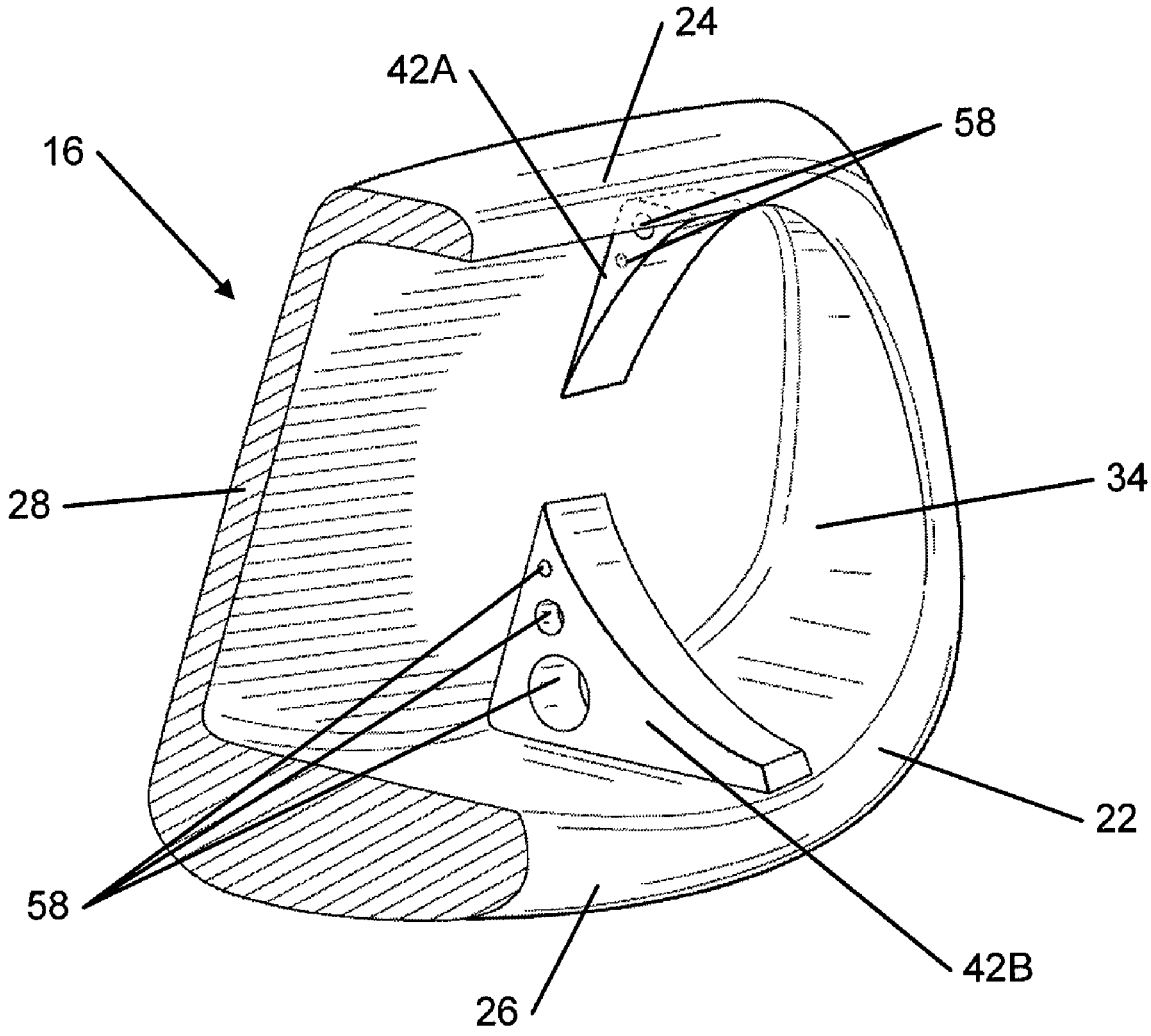
FIG. 8 illustrates a perspective cross-sectional view of an example golf club head in accordance with the present invention.

As shown in FIG. 8, in another example club head 16 structure according to this invention, the plurality of support brackets may include cored out holes 58 in one or more of the support brackets. By coring out holes 58 in one or more of the support brackets, weight can be removed from the support brackets 40, while also maintaining the structural integrity of the support brackets 40 and the striking face 28. As explained throughout, this weight savings generated from removing weight from the support brackets may then be placed in a location to alter the weight distribution to improve the playing characteristics of the golf club 10.

3. Dampening Portion According to Examples of this Invention

Figure 4:
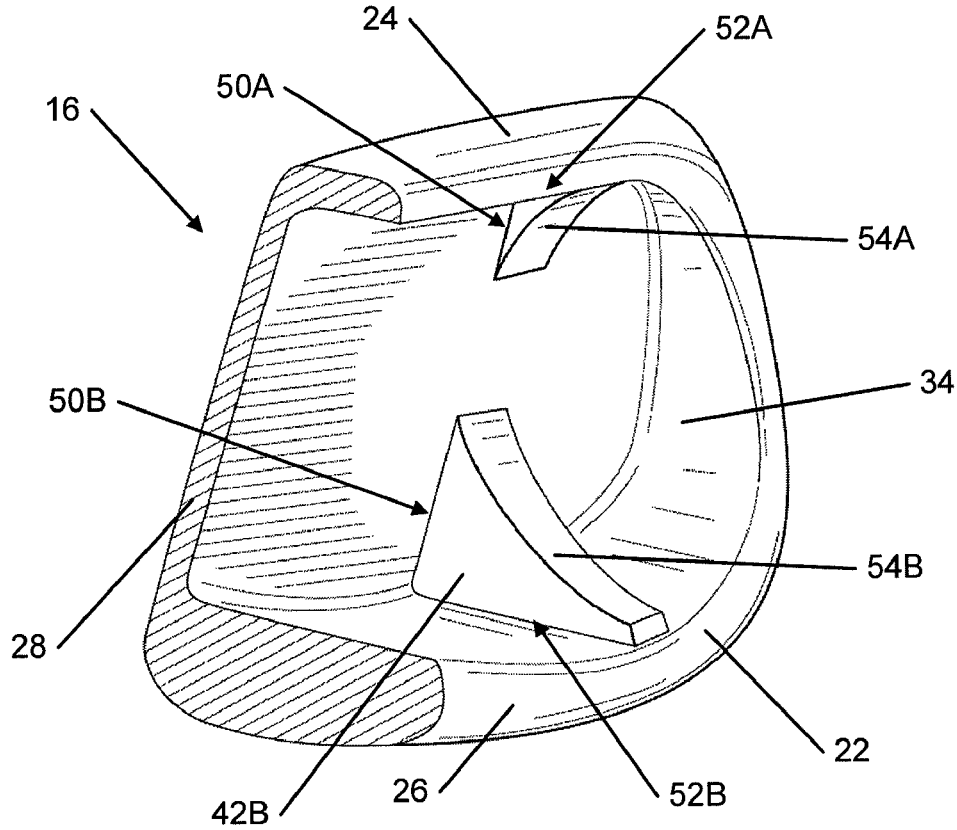
FIG. 4 illustrates a perspective cross-sectional view of another example golf club head in accordance with the present invention.
Figure 5:
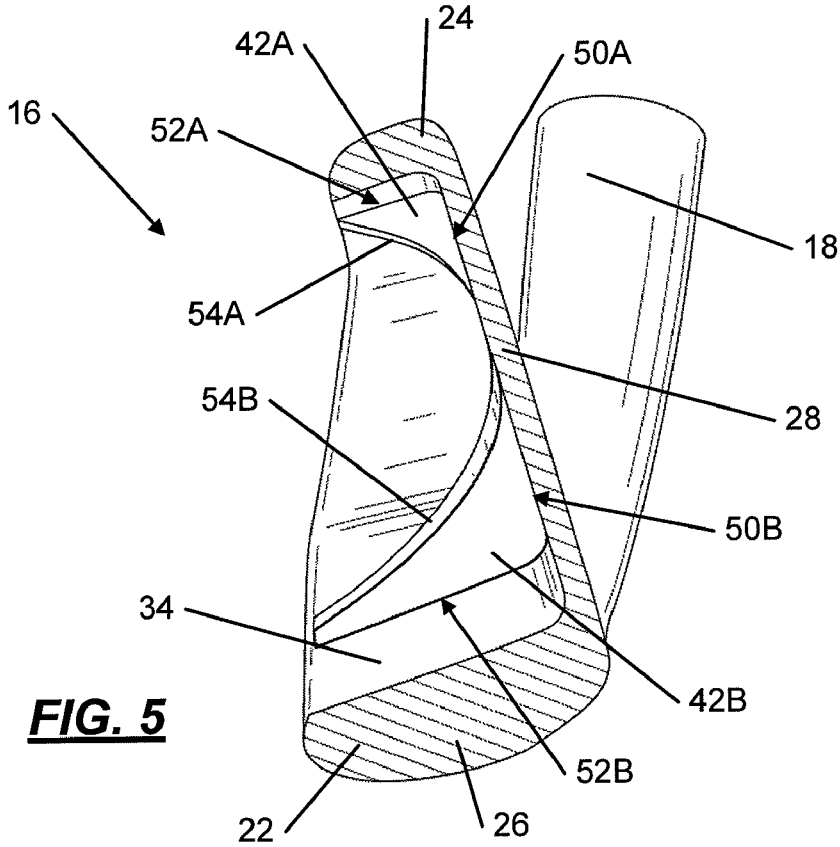
FIG. 5 illustrates a cross-sectional view of the example golf club head as illustrated in FIG. 4 in accordance with the present invention.

According to some aspects of this disclosure, a dampening portion 55 may be added or attached to the club head 16. As shown in FIGS. 3 and 3A, the dampening portion 55 may be located on the rear of the striking face 28. The damping portion 55 may be used to reduce vibration upon impact of the striking face 28 of the golf club head 16 with a golf ball. In addition, the damping portion 55 may also alter (e.g., dampen) the sound of the golf shot upon impact of the striking face 28 of the golf club head 16 with the golf ball. The damping portion 55 may also create a softer feeling and sound to the golf shot indicating a more controlled golf shot. The dampening portion 55 may be made of a thin carbon or urethane material, thermoplastic polyurethane (TPUs), rubbers, foams, and other non-metallic materials. The dampening portion 55 may be dimensioned such that thickness of the dampening portion is between approximately 0.02 inches and 0.125 inches. The dampening portion may be attached such that it covers, for example, 25 to 90% of the rear cavity area or the exposed rear surface of the striking face. In another configuration in accordance with this invention, as shown in FIGS. 4 and 5, the dampening portion is not included with the club head 16.

In another configuration in accordance with this invention the dampening portion 55 may have grooves, such that the support brackets 40, and more specifically the first sides 50A, 50B of the support brackets 42A, 42B may engage the striking face 28 flush, such that the entire first side 50A, 50B engages the striking face 28. These grooves may be located in the area where the first side 50A, 50B engages the striking face 28. Additionally, in another configuration in accordance with this invention, the first sides 50A, 50B may have notches in the area where the first sides 50A, 50B engage the dampening portion 55, such that the entire first side 50A, 50B is flush with either the striking face 28 or the dampening portion 55. In either of the above configurations, the entire first side 50A, 50B is flush with the rear of the club head 16. In another configuration, the first side 50A, 50B may be engaged with only the dampening portion 55, such that the first side 50A, 50B is partially separated from the rear surface of the striking face 28 immediately above or below the perimeter weighting member (ie., in the area between the perimeter weight and the dampening portion 55).

Additionally, the dampening portion 55 may be attached to the striking face 28 such that the dampening portion 55 provides swing weight customization. The dampening portion 55 may be placed at desired locations (e.g., low and toward the edges) to improve club head moment of inertia.

4. Discretionary Weight According to Examples of this Invention

Figure 9:
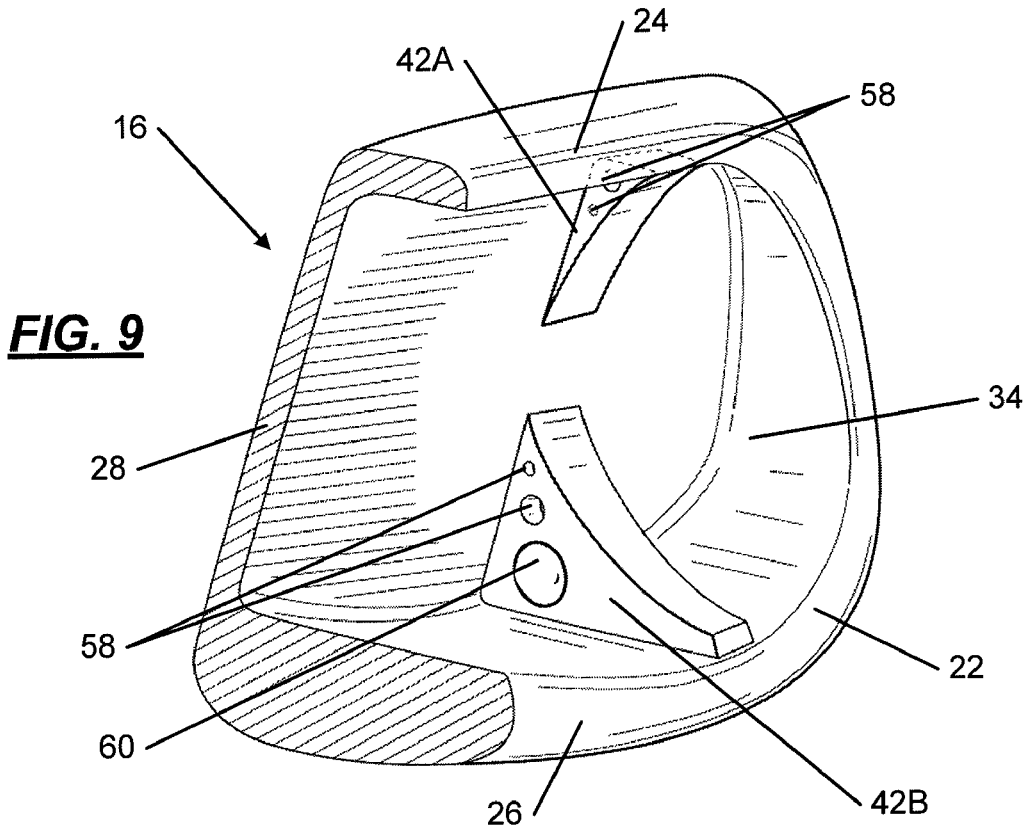
FIG. 9 illustrates a perspective cross-sectional view of an example golf club head in accordance with the present invention.
Figure 10:
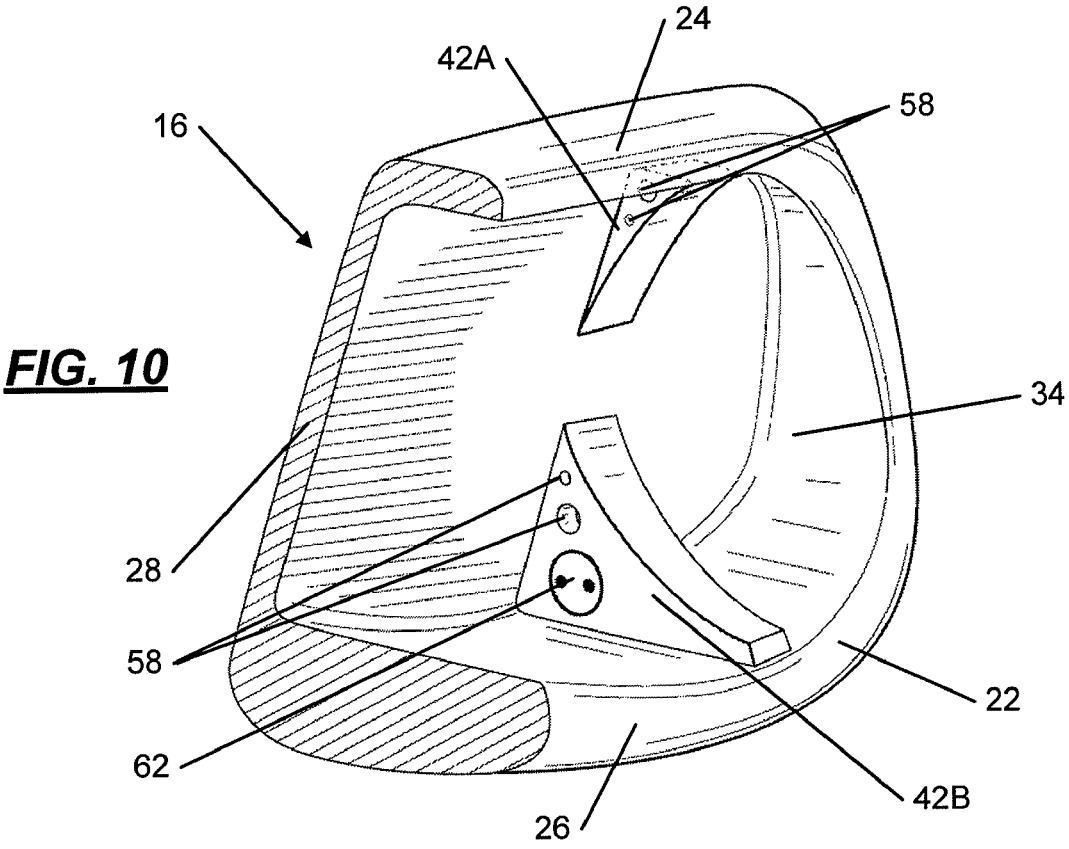
FIG. 10 illustrates a perspective cross-sectional view of an example golf club head in accordance with the present invention.

Because the club head 16 of the present invention includes a thinner striking face 28 than conventionally used, additional weight may be allowed to be placed at desired locations (e.g., low and toward the edges) to improve club head moment of inertia. In one example club head according to the invention, as illustrated in FIG. 10, a discretionary weight 60 may be added or attached to one or more than one of the support brackets. The discretionary weight 60 may also be integrally formed as part of the club head structure, by providing more dense materials where desired, such as at the heel 20 and/or the toe 22. As explained above, and shown in FIGS. 9 through 11, the support brackets 40 may include cored out holes or weight ports 58 in one or more of the support brackets 40. The discretionary weight 60 may be located within one or more of the cored out holes 58 in the support brackets 40. The discretionary weight 60 may be added to one or more than one of the lower support brackets 40, such that the weight may be placed low and in the rear portion 30 of the golf club head 16. There may be more than one discretionary weight 60 placed in any of the weight ports 58 in the support brackets 40.

Adding the discretionary weight 60 low and in the rear portion 30 of the club head 16, e.g., at the toe 22, may help to do two things. First, adding the discretionary weight 60 low and in the rear portion 30 may increase the moment of inertia (MOI) of the club head 16, which is known to increase the distance and/or accuracy for off-center shots (because the club head better resists twisting about the vertical axis and/or loss of velocity due to off-center hits). Second, adding the discretionary weight 60 low and in the rear portion 30 may lower the center of gravity for the golf club 10, making the center of gravity closer to the sole portion 26 of the club and/or closer in line to location where a golf ball hits the striking face. Making the center of gravity low will improve distance, improve the chance for solid connections, and make it easier to get the ball airborne. The discretionary weight 60 may be made of a heavy material, such as lead, tungsten, lead alloys, tungsten alloys, other metals or polymers that include lead or tungsten materials therein, etc.

Additionally, if desired, the discretionary weight 60 may be added or attached to one or more than one of the upper support brackets 42A, 44A, such that the weight may be placed high and in the rear portion 30 of the golf club head 16.

Further it is noted that while the depicted example structure shown in FIG. 10 demonstrates one placement of the discretionary weight 60 and one example of this disclosure, this is not to suggest that other variations are not contemplated within the scope of this disclosure. In fact, other desired variations may be provided without departing from this disclosure. The discretionary weight 60 may be provided at different locations on the club head 16. For example, the discretionary weight 60 may be located near the heel 20 of the club head 16. In another example, the discretionary weight 60 may be located near the toe 22 of the club head 16. Additionally, as shown in FIG. 11, the discretionary weights may be removable and temporary, screw-in type weights 62 that may be inserted into weight ports located at various positions around the club head 16. The screw-in type weights 62 could be of different masses. For example, with three weights, there may be an 8 gram weight, a 12 gram weight, and a 16 gram weight, or any other combination of masses without departing from the present invention. The club fitter or user could selectively toe weight, heel weight, etc., based on the weights chosen for the various weight ports. By varying the location of the discretionary weight 60 on the club head 16 can provide many advantages.

Additionally, as stated above, the discretionary weight 60 can be located in different positions to alter the weight distribution of the golf club head 16. By altering the weight distribution of the golf club head 16, the club head's 16 center of gravity may be located in a more desirable position for a specific golfer and specific swing characteristics.

For example, during a club fitting, a set of clubs with the discretionary weight 60 in different locations on the club head 16 can be used. The discretionary weight 60 can be selectively located in different locations (e.g., near the heel 20 in "long" irons to the toe 22 in "short" irons) to better conform to a particular golfer's swing or tendencies. For example, during a club fitting, in order to analyze a particular golfer's swing, tendencies, characteristics, etc., a club fitter could use a variety of techniques including: observation with the naked eye of either the swing and/or the golfer's body throughout the swing; recording and play back (e.g., in slow motion or real time) of the swing and/or the golfer's body throughout the swing; measurement of particular aspects of the swing including: the angle of the club head and/or the shaft throughout the swing (e.g., at the take away, during the downswing, at impact, during the follow through, etc.), velocity or acceleration of the club head throughout the swing, etc.; computer analysis of the swing, such as computer analysis of the above mentioned measurements and recordings; etc. Upon analyzing the particular golfer's swing or tendencies (e.g., in a manner described above), a club fitter could selectively attach a club head 16 with the discretionary weight 60 to the shaft 12 based on the analysis of at least one characteristic of a golfer's swing in a manner to better aid a particular golfer achieve a desired result. Therefore, the club fitter may exchange or replace the existing club head 16 with other interchangeable club heads 16 in order to better aid a particular golfer achieve a desired result. For example, if a golfer has a tendency to "slice" the golf ball, then the club fitter may attach a club head 16 with the discretionary weight 60 that provides more mass in the heel 20. Conversely, if a golfer has a tendency to "hook" the golf ball, then the club fitter may attach a club head 16 with the discretionary weight 60 that provides more mass in the toe 22.

Additionally, the club fitter may exchange or move the discretionary weight 60 within the same club head to alter the characteristic of the club head to better aid a particular golfer achieve a desired result. For example, if a golfer has a tendency to "slice" the golf ball, then the club fitter may exchange or move the discretionary weights 60 so that there is more mass in the heel 20. Conversely, if a golfer has a tendency to "hook" the golf ball, then the club fitter may exchange or move the discretionary weights 60 so that there is more mass in the toe 22.

Figure 13:
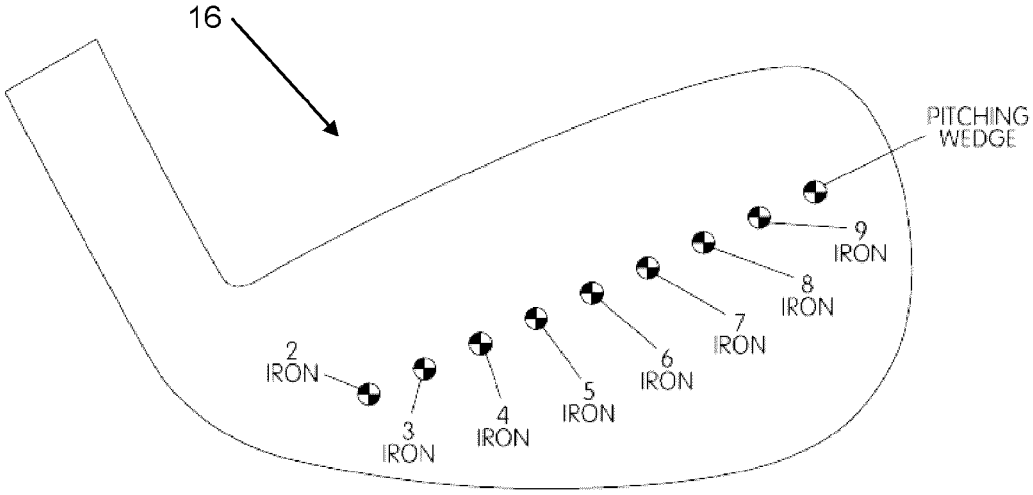
FIG. 13 schematically shows a progression of the center of gravity of a golf club head in a set of golf clubs in accordance with the present invention.

Additionally, various irons in a set may have different support brackets 40 and/or different discretionary weights 60 to differently position the center of gravity of the club head 16. FIG. 13 schematically shows an entire exemplary progression of the position of the center of gravity in a set of golf clubs according to an illustrative embodiment of this disclosure. It is noted that the schematic rendering shown in FIG. 13 is not to scale and, instead, is used merely to give the reader a sense of the general progression of the center of gravity for one embodiment of this disclosure. As seen in FIG. 13, the progression begins as a 2-iron (one of the club head bodies with a low degree of loft relative to the set of club head bodies) with the center of gravity located generally toward the lower heel end 20 of the club head 16. The progression continues from the lower heel 20 toward the upper toe 22 of the club head 16 until the progression ends as a pitching wedge (one of the club heads with a high degree of loft relative to the set of club heads) with the center of gravity located generally toward the upper toe end 22 of the club head 16. It is noted of course, that this is merely one illustrative embodiment of a set of golf clubs according to this disclosure and other sets of golf clubs according to this disclosure may include other clubs, such as sand wedges, lob wedges, hybrids irons, etc. Further, it is noted that other desired progressions or arrangements may be provided without departing from this disclosure.

These different locations of the center of gravity of the club heads 16 can affect the trajectory and ball flight of a golf ball struck by the golf club. Hence, it is understood that selectively positioning the support brackets 40 and/or the discretionary weight 60 can produce a set of golf clubs with desirable characteristics. For example, a "long" iron of such a set of golf clubs has a club head 16 with a center of gravity near the hosel 18. Hence, such "long" irons can aid a golfer in imparting a "draw" trajectory to the golf ball and, therefore, provide characteristics of a "draw" shot (i.e., less backspin, further roll and lower ball flight) which will tend to increase the distance that the golf ball will travel upon being struck by the golfer. Conversely, a "short" iron of such a set of golf clubs has a club head 16 with a center of gravity near the toe 22. Hence, such "short" irons can aid a golfer in imparting "fade" trajectory to the golf ball and, therefore, provide characteristics of a "fade" shot (i.e., more backspin, less roll and higher ball flight) which tend to provide enhanced ball control (e.g., stopping the ball on the green).

As discussed above, the weighting features of golf club heads in accordance with this disclosure are not limited to controlling the horizontal position of the golf club's center of gravity (the horizontal position when the golf club is oriented at a ball addressing position). Rather, the center of gravity in the vertical direction also may be selectively controlled, if desired, in at least some examples of golf club head structures according to this disclosure. Increasing the weight in the top portion 24 of the club head 16 produces a higher center of gravity in the golf club head which can provide a lower initial ball flight path, e.g., for play in windy conditions, to provide more "running" shots, etc. Conversely, increasing the weight in the sole portion 26 of the club head 16 produces a lower center of gravity in the golf club head which can provide a more lofted golf ball flight path, which can help a golfer get the ball in the air.

A variety of different cored-out hole or weight port sizes and/or shapes may be provided without departing from this invention. Additionally, the various support brackets 40 may have the same or different cored-out hole or weight port specifications and/or arrangements from one another without departing from this invention.

Additionally, the discretionary weight 60 may be incorporated into other locations of the club head, such as in the perimeter weight member 34, especially at the sides and bottom. The discretionary weight 60 also may be added as a separate element as described above or it may be provided: (a) by "beefing up" the various locations of the club head structure (e.g., the sides and bottom of the perimeter weight), (b) by selecting denser materials for various locations of the club head structure (e.g., the sides and bottom of the perimeter weight), etc.

Any of the above configurations of the support brackets 40 may provide adequate reinforcement for the thin striking face 28, while also reducing as much weight as possible and maintaining the structural integrity of the golf club head 16.

C. Detailed Description of Additional Aspects of this Invention

Method of Producing the Golf Club

Additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head 16 of the various types described above (including any or all of the various structures, features, and/or arrangements described above), e.g., by manufacturing or otherwise constructing the golf club head 16, such as some or all of the various individual parts of the club head made from multiple pieces that are connected together (e.g., by adhesives or cements; by welding, soldering, or brazing, or other fusing techniques; by mechanical connectors, etc.) or by obtaining the golf club head 16 from a third party source, etc.; (b) engaging a shaft 12 with the golf club head 16 in any suitable or desired manner, including conventional manners known and used in the art, e.g., via adhesives, cements, welding, soldering, mechanical connectors (such as threads, retaining elements, or the like and in a releasable manner to allow easy interchange of one shaft 12 for another on the club head 16); and (c) engaging a grip 14 with the shaft member 12, such as attaching to, engaging with, or extending from the shaft member 12 in any suitable or desired manner, including conventional manners known and used in the art, e.g., using adhesives or cements, via welding, soldering, brazing, or the like, via mechanical connectors (such as threads, retaining elements, etc., including through releasable connection structure).

The various parts (e.g., top portion 24, sole portion 26, support brackets 40, etc.) may be made from any desired materials and combinations of different materials, including materials that are conventionally known and used in the art, such as metal materials, including lightweight metal materials, composite materials, polymer materials, steel, titanium, aluminum, tungsten, magnesium, beryllium, alloys including one or more of these metals, carbon-fiber reinforced materials, glass-fiber reinforced materials, graphite, etc.

Additionally, the club head 16 may be constructed in any suitable or desired manner and/or from any suitable or desired materials without departing from this disclosure, including from conventional materials and/or in conventional manners known and used in the art. The club head 16 and its various parts may be made by forging, casting, molding, and/or using other techniques and processes, including techniques and processes that are conventional and known in the art.

D. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. A golf club head, comprising:

a striking face providing a front surface for engaging a golf ball and a rear surface opposite the front surface, wherein at least 50% of an overall surface of the striking face has a thickness from the front surface to the rear surface of no greater than 0.1 inches;

a perimeter weighting member extending rearward from the striking face and around at least a majority of a circumference of the striking face, wherein the perimeter weighting member at least partially defines a rear cavity in the golf club head;

a plurality of support brackets at least partially located in the rear cavity, wherein at least one of the plurality of support brackets has a first portion engaged to the rear surface of the striking face, a second portion engaged to the perimeter weighting member and a third portion connecting the first and second portion; and at least one discretionary weight engaged with at least one support bracket, wherein the at least one discretionary weight is located within a weight port defined in the at least one support bracket.

2. The golf club head of claim 1, wherein the plurality of support brackets includes at least one upper support bracket engaged to the perimeter weighting member at a top portion of the club head.

3. The golf club head of claim 1, wherein the plurality of support brackets includes at least one lower support bracket engaged to the perimeter weighting member at a sole portion of the club head.

4. The golf club head of claim 3, further comprising at least one discretionary weight engaged with at least one lower support bracket.

5. The golf club head of claim 1, wherein the plurality of support brackets includes at least one pair of support brackets, wherein the pair of support brackets includes an upper support bracket and a lower support bracket, wherein the upper support bracket is engaged to the perimeter weighting member at a top portion of the club head and the lower support bracket is engaged to the perimeter weighting member at a sole portion of the club head.

6. The golf club head of claim 1, wherein the plurality of support brackets includes two pairs of support brackets, wherein each pair of support brackets includes an upper support bracket and a lower support bracket, wherein the upper support brackets are engaged to the perimeter weighting member at a top portion of the club head and the lower support brackets are engaged to the perimeter weighting member at a sole portion of the club head.

7. The golf club head of claim 1, wherein the at least one discretionary weight is at least 4 grams.

8. The golf club head of claim 1, wherein the at least one discretionary weight is within a range of 5 grams to 40 grams.

9. The golf club head of claim 1, wherein the third portion is a concavely curved surface, such that the curved surface curves inward toward the striking face and the perimeter weighting member.

10. The golf club head of claim 9, wherein the curved surface is equivalent to an arc of a circle with a radius.

11. The golf club head of claim 10, wherein a ratio of a height of the striking face to the radius is within a range of 0.75 to 5.

12. The golf club head of claim 10, wherein a ratio of a height of the striking face to the radius is approximately 1.

13. The golf club head of claim 10, wherein a ratio of a height of the striking face to the radius is approximately 3.

14. The golf club head of claim 1, wherein the support brackets are made of a material selected from the group consisting of: aluminum, magnesium, beryllium, titanium, aluminum alloys, magnesium alloys, beryllium alloys, titanium alloys, thermoplastic polymers, thermosetting polymers, carbon-fiber reinforced composite materials, and glass-fiber reinforced materials.

15. The golf club head of claim 1 wherein the at least one discretionary weight is made of a material selected from the group consisting essentially of lead, tungsten, lead alloys, tungsten alloys, and polymeric materials.

16. An iron-type golf club, comprising:

a shaft;

a grip attached to the shaft; and a golf club head configured to engage with the shaft, wherein the golf club head further includes:

a striking face providing a front surface for engaging a golf ball and a rear surface opposite the front surface, wherein at least 50% of an overall surface of the striking face has a thickness from the front surface to the rear surface of no greater than 0.1 inches;

a perimeter weighting member extending rearward from the striking face and around at least a majority of a circumference of the striking face, wherein the perimeter weighting member at least partially defines a rear cavity in the golf club head;

a plurality of support brackets at least partially located in the rear cavity, wherein at least one of the plurality of support brackets has a first portion engaged to the rear surface of the striking face, a second portion engaged to the perimeter weighting member and a third portion connecting the first and second portion; and at least one discretionary weight engaged with at least one support bracket, wherein the at least one discretionary weight is located within a weight port defined in the at least one support bracket.

17. The golf club of claim 16, wherein the plurality of support brackets includes at least one upper support bracket engaged to the perimeter weighting member at a top portion of the club head.

18. The golf club of claim 16, wherein the plurality of support brackets includes at least one lower support bracket engaged to the perimeter weighting member at a sole portion of the club head.

19. The golf club of claim 18, further comprising at least one discretionary weight engaged with at least one lower support bracket.

20. The golf club of claim 16, wherein the plurality of support brackets includes at least one pair of support brackets, wherein the pair of support brackets includes an upper support bracket and a lower support bracket, wherein the upper support bracket is engaged to the perimeter weighting member at a top portion of the club head and the lower support bracket is engaged to the perimeter weighting member at a sole portion of the club head.

21. The golf club of claim 16, wherein the plurality of support brackets includes two pairs of support brackets, wherein each pair of support brackets includes an upper support bracket and a lower support bracket, wherein the upper support brackets are engaged to the perimeter weighting member at a top portion of the club head and the lower support brackets are engaged to the perimeter weighting member at a sole portion of the club head.

22. The golf club of claim 16, wherein the at least one discretionary weight is at least 4 grams.

23. The golf club of claim 16, wherein the at least one discretionary weight is within a range of 5 grams to 40 grams.

24. The golf club of claim 16, wherein the third portion is a concavely curved surface, such that the curved surface curves inward toward the striking face and the perimeter weighting member.

25. The golf club of claim 24, wherein the curved surface is equivalent to an arc of a circle with a radius.

26. The golf club of claim 25, wherein a ratio of a height of the striking face to the radius is within a range of 0.75 to 5.

27. The golf club head of claim 25, wherein a ratio of a height of the striking face to the radius is approximately 1.

28. The golf club head of claim 25, wherein a ratio of a height of the striking face to the radius is approximately 3.

29. The golf club head of claim 16, wherein the plurality of support brackets are made of a material selected from the group consisting of: aluminum, magnesium, beryllium, titanium, aluminum alloys, magnesium alloys, beryllium alloys, titanium alloys, thermoplastic polymers, thermosetting polymers, carbon-fiber reinforced composite materials, and glass-fiber reinforced materials.

30. The golf club head of claim 16, wherein the at least one discretionary weight is made of a material selected from the group consisting essentially of lead, tungsten, lead alloys, tungsten alloys, and polymeric materials.

* * * * *